United States Patent [19]

Przezdziecki

[11] Patent Number: 4,459,350

[45] Date of Patent: Jul. 10, 1984

[54] PHOTOTHERMOGRAPHIC MATERIAL AND PROCESSING COMPRISING A SUBSTITUTED TRIAZINE

[75] Inventor: Wojciech M. Przezdziecki, Rochester, N.Y.

[73] Assignee: Eastman Kodak Company, Rochester, N.Y.

[21] Appl. No.: 427,065

[22] Filed: Sep. 29, 1982

[51] Int. Cl.[3] ..... G03C 1/02

[52] U.S. Cl. ..... 430/353; 430/607; 430/614; 430/619; 430/620; 430/9; 430/955

[58] Field of Search ..... 430/9, 619, 955, 614, 430/353, 607, 620

[56] References Cited

U.S. PATENT DOCUMENTS 3,457,075 7/1969 Morgan .
3,874,946 4/1975 Costa et al. .
3,877,940 4/1975 Ericson .
3,955,982 5/1976 VanAllan et al. .
3,987,037 10/1976 Bonham et al. .
4,108,665 8/1978 Gutman et al. .
4,189,323 2/1980 Buhr .
4,264,725 4/1981 Reeves .

OTHER PUBLICATIONS

Research Disclosure, Jun. 1978, No. 17029.

*Primary Examiner*—Won H. Louie, Jr.
*Attorney, Agent, or Firm*—Richard E. Knapp

[57] ABSTRACT

A 6-substituted-2,4-bis(trichloromethyl)-s-triazine stabilizer precursor which has a maximum absorption wavelength greater than 320 nanometers and is thermally stable at temperatures up to 150° C. provides improved post-processing stability in a photothermographic silver halide material designed for dry physical development. Such a photothermographic material comprises photographic silver halide and an image forming combination comprising (i) an organic silver salt oxidizing agent, with (ii) a reducing agent for the organic silver salt oxidizing agent. A developed visible image is provided after imagewise exposure by uniformly heating the photothermographic material to moderately elevated temperatures.

12 Claims, No Drawings

PHOTOTHERMOGRAPHIC MATERIAL AND PROCESSING COMPRISING A SUBSTITUTED TRIAZINE

BACKGROUND OF THE INVENTION

1. Field of the Invention

This invention relates to a photothermographic silver halide material and process for producing in such a material improved post-processing image stability by means of a 6-substituted-2,4-bis(trichloromethyl)-s-triazine stabilizer precursor.

2. Description of the State of the Art

Photothermographic silver halide materials for producing an image by thermal processing are known. Such photothermograpic materials can include a photolytically active stabilizer precursor, such as described in U.S. Pat. No. 3,874,946.

A stabilizer or stabilizer precursor is necessary in a photothermographic material because such a material is designed to eliminate a fixing step that normally would remove undeveloped silver. Such a photothermographic material is described in, for example, *Research Disclosure* June 1978, Item No. 17029. The stabilizer precursor is a means to provide post-processing stabilization to enable room-light handling capability following thermal processing. Stabilizer precursors for this purpose in photothermographic silver halide materials are, for instace, 2-tribromomethylsulfonylbenzothiazole and 2,4-bis(tribromomethyl)6-methyltriazine described in U.S. Pat. No. 3,874,946. These photolytically active stabilizer precursors, however, adversely affect photographic speed and storage stability prior to thermal processing.

Other known stabilizer precursors exhibit one or more of the following disadvantages:

reduced stability of the photothermographic material prior to thermal processing of the photothermographic material, reduced photographic speed, insufficient stabilization either to thermal instability of the photolytic stabilizer precursor at processing temperature, or to insufficient light absorption above about 300 nanometers.

SUMMARY OF THE INVENTION

It has been found according to the invention that improved post-processing stability without the above disadvantages is provided by means of a 6-substituted-2,4-bis(trichloromethyl)-s-triazine stabilizer precursor which has a maximum absorption wavelength greater than 320 nanometers and is thermally stable up to about 150° C. A preferred stabilizer precursor is represented by the structure:

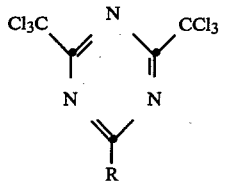

wherein

R is aryl containing 6 to 15 carbon atoms, such as naphthyl and phenyl or —CH=CH—$R^1$; and $R^1$ is aryl containing 6 to 15 carbon atoms, such as phenyl and naphthyl.

The stabilizer precursor according to the invention provides improved post-processing stability in a photothermographic material comprising, in reactive association, preferably in a binder:

(a) photographic silver halide, (b) an image forming combination comprising (i) an organic silver salt oxidizing agent, with (ii) a reducing agent for the organic silver salt oxidizing agent.

A developed image is produced in such a photothermographic material after exposure, such as exposure to radiation by merely heating the photothermographic material at processing temperature, such as a temperature within the range of about 90° C. to about 150° C. until a developed image is produced.

The stabilizer precursor according to the invention is photolytically active and does not require heating to produce a stabilizing moiety.

DETAILED DESCRIPTION OF THE INVENTION

A variety of photolytically active chlorine compound stabilizer precursors as described within the above formula are useful according to the invention to provide post-processing image stability without adversely affecting photographic speed and storage stability prior to thermal processing. It is believed that the photolytically active chlorine compounds are precursors to the moiety which upon combination with silver ions or atoms prevents instability due to light exposure. The exact mechanism of stabilization is not fully understood. It is believed that upon imagewise exposure of a photothermographic material containing photographic silver halide to actinic radiation, latent image specks of metallic silver are formed in the photographic silver halide remaining in the background areas of the photographic element. This produces unwanted background printup, especially after subsequent overall heating. It is believed that the chlorine from the described stabilizer precursor is at least in part released photolytically and attacks and destroys the latent image metallic silver sites before they produce printup. This occurs before background fog is produced and without attacking the developed silver image to any significant degree. It is believed that the photolytically released chlorine comprises free radicals which reoxidize the latent image silver atoms in the photographic silver halide to silver ions.

The chlorine containing stabilizer precursors according to the invention have sufficient thermal stability to be useful in the photothermographic materials according to the invention without adversely affecting image development during thermal processing. The chlorine compounds according to the invention are thermally stable up to about 150° C.

The 6-substituted-s-triazine moiety is believed to be a chromophore group. The term "chromophore group" herein means a group which imparts to the chlorine compound stabilizer precursor containing the group the ability to release at least one chlorine atom when exposed to electromagnetic radiation having a wavelength greater than 320 nm. Those moieties which provide such ability are s-triazine moieties containing a substituent in the 6-position as described in the above formula. A variety of aromatic groups are useful in the 6-position of the s-triazine moiety. These aryl groups can contain substituents which do not adversely affect the stabilizing action of the stabilizer precursor according to the invention. Examples of such substituent groups include alkyl containing one to three carbon atoms, such as methyl, ethyl, propyl and alkoxy such as methoxy. It is important that the substituent groups not adversely affect the desired light absorption above 320 nm. This maximum absorption wavelength greater than 320 nm provides sufficient light absorption to enable the desired photolytic activity of the chlorine compounds.

Examples of 6-substituted-2,4-bis(trichloromethyl)-s-triazines useful as stabilizer precursors in photothermographic materials according to the invention include:

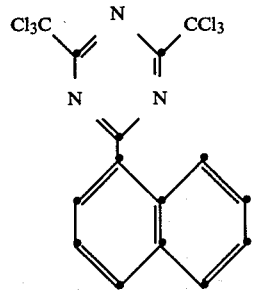

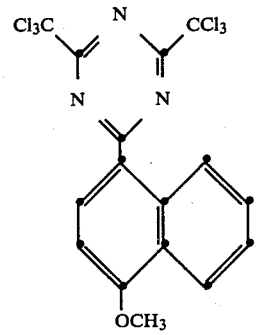

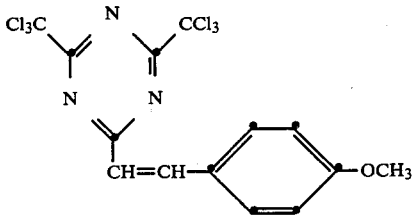

and

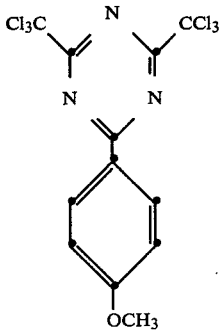

Combinations of these stabilizer precursors are also useful.

The described stabilizer precursors are prepared by methods known in the organic synthesis art. Such methods are described in, for example, U.K. Patent Specification No. 1,602,903.

It is not necessary to remove all impurities from the stabilizer precursor compositions according to the invention. These impurities can be separated, if desired, before mixing the stabilizer precursor with the photothermographic components according to the invention.

The 6-substituted-2,4-bis(trichloromethyl)-s-triazine stabilizer precursors according to the invention are useful in many photothermographic silver halide materials designed for dry physical development. Examples of useful photothermographic materials in which the stabilizer precursors of the invention are useful are described in, for example, U.S. Pat. No. 3,457,075; U.S. Pat. No. 4,264,725; and, *Research Disclosure,* June 1978, Item No. 17029. The stabilizer precursors of the invention are especially useful in photothermographic materials comprising, generally in a binder, in reactive association, (a) photographic silver halide, prepared in situ or ex situ, (b) an image-forming combination comprising (i) an organic silver salt oxidizing agent, preferrably a silver salt of a long-chain fatty acid, such as silver behenate, with (ii) a reducing agent for the organic silver salt oxidizing agent, preferrably a phenolic reducing agent.

A preferred embodiment of the invention comprises a photothermographic element comprising a support having thereon, in a binder (preferably a poly(vinylbutyral) binder), in reactive association, (a) photographic silver halide, prepared in situ or ex situ, (b) an oxidation-reduction image-forming combination comprising (i) an organic silver salt oxidizing agent consisting essentially of silver behenate, with (ii) a phenolic reducing agent for the organic silver salt oxidizing agent, preferrably a sulfonamidophenol reducing agent, with a stabilizing concentration of the photolytically active 6-substituted-2,4-bis(trichloromethyl)-s-triazine which has a maximum absorption wavelength greater than 320 nm and is thermally stable at temperatures up to 150° C. It is also preferred to include, in the element, a thermal stabilizer consisting essentially of a stabilizing concentration of a 2-bromo-2-arylsulfonylacetamide, such as 2-bromo-2-p-tolylsulfonylacetamide.

An optimum stabilizing concentration of a stabilizer precursor according to the invention depends upon different factors such as the particular photothermographic material, particular components in the photothermographic material, desired image, particular stabilizer precursor and processing conditions. A preferred concentration of stabilizer precursor is within the range of about 0.008 mole to about 0.1 mole of the stabilizer precursor per mole of total silver in the photothermographic material. An especially useful concentration is within the range of about 0.01 mole to about 0.03 mole of the stabilizer precursor per mole of total silver in the photothermographic material. When combinations of stabilizer precursors are present in the photothermographic material, the total concentration of stabilizer precursors is preferably within the described concentration range.

The photothermographic materials according to the invention comprise a photosensitive component which consists essentially of photographic silver halide. In the photothermographic materials it is believed that the latent image silver from the silver halide acts as a catalyst for the described oxidation-reduction image-forming combination upon processing. A preferred concentration of photographic silver halide is within the range of about 0.01 to about 20 moles of photographic silver halide per mole of organic silver salt oxidizing agent, such as per mole of silver behenate, in the photothermographic material. Other photosensitive silver salts are useful in combination with the photographic silver halide if desired. Preferred photographic silver halides are silver chloride, silver bromide, silver bromoiodide, silver chlorobromoiodide and mixtures of these silver halides. Very fine grain photographic silver halide is especially useful. The photographic silver halide can be prepared by any of the procedures known in the photographic art. Such procedures for forming photographic silver halide and forms of photographic silver halide are described in, for example, *Research Disclosure,* June 1978, Item No. 17029 and *Research Disclosure,* December 1978, Item No. 17643. The photographic silver halide can be unwashed or washed, chemically sensitized, protected against the production of fog and stabilized against loss of sensitivity during keeping as described in the above Research Disclosure publications. The silver halide can be prepared in situ as descibed in, for example, U.S. Pat. No. 3,457,075.

The photothermographic materials according to the invention comprise an oxidation-reduction image-forming combination which contains an organic silver salt oxidizing agent, preferrably a silver salt of a long-chain fatty acid. Such organic silver salt oxidizing agents are resistant to darkening upon illumination. Preferred organic silver salt oxidizing agents are silver salts of long-chain fatty acids containing 17 to 30 carbon atoms. Examples of useful organic silver salt oxidizing agents are silver behenate, silver stearate, silver oleate, silver laurate, silver hydroxystearate, silver caprate, silver myristate and silver palmitate. Combinations of organic silver salt oxidizing agents are also useful. Examples of useful silver salt oxidizing agents which are not silver salts of long-chain fatty acids include, for example, silver benzoate, silver benzotriazole, silver terephthalate and silver phthalate.

The optimum concentration of organic silver salt oxidizing agent in a photothermographic material according to the invention will vary depending upon the desired image, particular organic silver salt oxidizing agent, particular reducing agent and particular photothermographic element. A preferred concentration of organic silver salt reducing agent is preferrably within the range of about 0.2 to about 2 moles of organic silver salt reducing agent per mole of Ag. When combinations of organic silver salt oxidizing agents are present, the total concentration of organic silver salt oxidizing agent is preferably within the described concentration range.

A variety of reducing agents are useful in the photothermographic materials according to the invention. Examples of useful reducing agents include substituted phenols and naphthols such as bis-$\beta$-naphthols; polyhydroxybenzenes, such as hydroquinones, including hydroquinone, alkyl-substituted hydroquinones, such as tertiarybutylhydroquinone, methylhydroquinone, 2,5-dimethylhydroquinone and 2,6-dimethylhydroquinone; catechols and pyrogallols; aminophenol reducing agents, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1-phenyl-3-pyrazolidone; sulfonamidophenols and other organic reducing agents described in *Research Disclosure,* June 1978, Item No. 17029, the description of which is incorporated herein by reference. Combinations of organic reducing agents are also usful.

Preferred organic reducing agents in photothermographic materials according to the invention are sulfonamidophenol reducing agents, such as described in U.S. Pat. No. 3,801,321. Examples of useful sulfonamidophenol reducing agent include 2,6-dichloro-4-benzenesulfonamidophenol; benzenesulfonamidophenol; 2,6-dibromo-4-benzenesulfonamidophenol and mixtures thereof.

An optimum concentration of reducing agent in a photothermographic material according to the invention varies depending upon such factors as the particular photothermographic element, desired image, processing conditions, the particular organic silver salt oxidizing agent and the particular stabilizer precursor. A preferred concentration of reducing agent is within the range of about 0.2 mole to about 2.0 moles of reducing agent per mole of silver in the photothermographic material. When combinations of reducing agents are present, the total concentration of reducing agent is preferably within the described concentration range.

The photothermographic material preferrably comprises a toning agent, also known as an activator-toning agent or a toner-accelerator. Combinations of toning agents are useful in photothermographic materials according to the invention. An optimum toning agent or toning agent combination depends upon such factors as the particular photothermographic material, particular components in the photothermographic material, desired image and processing conditions. Examples of useful toning agents and toning agent combinations are described in, for example, *Research Disclosure,* June 1978, Item No. 17029. Examples of useful toning agents include, for instance, phthalimide, N-hydroxyphthalimide, N-potassiumphthalimide, succinimide, N-hydroxy-1,8-naphthalimide, phthalazine, 1-(2H)-phthalazinone and 2-acetylphthalazinone.

In addition to combinations of stabilizers which are photolytically active according to the invention, other image stabilizers or stabilizer precursors are usful with the photolytically active chlorine compound stabilizer precursors of the invention. Examples of useful stabilizer precursors which are useful in combination with stabilizer precursors of the invention include, for instance, azole thioethers and blocked azolinethione stabilizer precursors and carbamoyl stabilizer precursors such as described in U.S. Pat. No. 3,877,940.

Photothermographic materials according to the invention preferably contain various colloids and polymers alone or in combination as vehicles, binding agents and in various layers. Useful materials are hydrophobic or hydrophilic. They are transparent or translucent and include both naturally occuring substances such as proteins, for example, gelatin, gelatin derivatives, cellulose derivatives, polysaccharides, such as dextran, gum arabic and the like; and synthetic polymeric substances, such as water-soluble polyvinyl compounds like poly(-vinylpyrrolidone) and acrylamide polymers. Other synthetic polymeric compounds which are useful include dispersed vinyl compounds such as in latex form and particularly those which increase dimensional stability of photographic materials. Effective polymers include water insoluble polymers of alkylacrylates and methacrylates, acrylic acid, sulfoalkylacrylates and those which have cross-linking sites which facilitate hardening or curing. Preferred high molecular weight materials and resins include poly(vinylbutyral), cellulose acetate butyrate, poly(methylmethacrylate), poly(vinylpyrrolidone), ethyl cellulose, polystyrene, poly(vinylchloride), chlorinated rubbers, polyisobutylene, butadiene-styrene copolymers, vinyl chloride-vinylacetate copolymers, copolymers of vinylacetate, vinylchloride and maleic acid, poly(vinylalcohol) and polycarbonates.

Photothermographic materials according to the invention can contain development modifiers that function as speed increasing compounds, sensitizing dyes, hardeners, antistatic layers, plastisizers and lubricants, coating aids, brighteners, absorbing and filtered dyes, such as described in *Research Disclosure,* June 1978, Item No. 17029 and *Research Disclosure,* December 1978, Item No. 17643.

The photothermographic elements according to the invention comprise a variety of supports. Examples of useful supports include poly(vinylacetal) film, polystyrene film, poly(ethyleneterephthalate) film, polycarbonate film and related films or resinous materials, as well as glass, paper, metal and other supports which can withstand the processing temperatures useful in developing an image according to the invention.

The photothermographic compositions and other compositions according to the invention are coated on a suitable support by coating procedures known in the photographic art, including dip coating, air knife coating, curtain coating or extrusion coating using hoppers. If desired, two or more layers are coated simultaneously.

Spectral sensitizing dyes are useful in the described photothermographic materials to confer additional sensitivity to the elements and compositions of the invention. Useful sensitizing dyes are described in, for example, *Research Disclosure,* June 1978, Item No. 17029 and *Research Disclosure,* December 1978, Item No. 17643.

A photothermographic material according to the invention preferrably comprises a thermal stabilizer to help stabilize the photothermographic material prior to imagewise exposure and thermal processing. Such a thermal stabilizer aids in latent image keeping and improvement of stability of the photothermographic material during storage prior to exposure and processing. Preferred thermal stabilizers are (a) 2-bromo-2-arylsulfonylacetamides, such as 2-bromo-2-p-tolylsulfonylacetamide,
(b) 2(tribromomethyl sulfonyl) benzthiazone and
(c) 6 substituted-2,4-bis(tribromomethyl)-s-triazines, such as 6-methyl or 6-phenyl-2,4-bis(tribromomethyl)-s-triazine.

An optimum concentration of a thermal stabilizer in a photothermographic material according to the invention depends upon such factors as the particular stabilizer, particular components of the photothermographic material, desired image and processing conditions. A preferred concentration of thermal stabilizer is within the range of 0.01 to about 0.1 moles of thermal stabilizer per mole of Ag in the photothermographic material.

The photothermographic materials according to the invention are imagewise exposed by means of various forms of energy. Such forms of energy include those to which the photosensitive silver halide is sensitive and encompass the ultraviolet, visible and infrared regions of the electromagnetic spectrum as well as electron beam and beta radiation, gamma ray, X-ray, alpha particle, neutron radiation and other forms of corpuscular wave-like radiant energy in either non-coherent (random phase) forms or coherent (in phase) forms as produced by lasers. Exposures are monochromatic, orthochromatic, or panchromatic depending upon the spectral sensitization of the photographic silver halide. Imagewise exposure is preferrably for a sufficient time and intensity to produce a developable latent image in the photothermographic material. After imagewise exposure of the photothermographic material, the resulting latent image is developed merely by overall heating the element to moderately elevated temperatures. This overall heating merely involves heating the photothermographic element to a temperature within the range of about 90° C. to about 150° C. until a developed image is produced such as within about 0.5 to about 60 seconds. By increasing or decreasing the length of time of heating, a higher or lower temperature within the described range is useful depending upon the desired image, the particular components of the photothermographic material and heating means. A preferred processing temperature is within the range of about 100° C. to about 130° C.

Heating means known in the photothermographic art are useful for providing the desired processing temperature range. The heating means is, for example, a simple hot plate, iron, roller, heated drum, microwave heating means, heated air or the like.

Processing is preferably carried out under ambient conditions of pressure and humidity. Conditions outside normal atmospheric pressure and humidity are useful if desired.

The stabilizer precursor according to the invention is in any suitable location in the photothermographic material according to the invention which provides the desired stabilized image. If desired, one or more components of the photothermographic material according to the invention are in one or more layers of the material. For example, in some cases, it is desirable to include certain percentages of the reducing agent, toner, stabilizer precursor and/or other addenda in a protective layer over the photothermographic layer of the element. This, in some cases, reduces migration of certain addenda in the layers of the photothermographic element.

A photothermograhic composition according to the invention optionally comprises a hydrophilic photosensitive silver halide emulsion containing a gelatino peptizer with an organic solvent mixture. An example of such a photothermographic material according to the invention is prepared by very thoroughly mixing, such as by ultrasonic wave mixing, (I) a hydrophilic photosensitive silver halide emulsion with
(II) an organic solvent mixture comprising
  (A) an alcohol photographic speed increasing solvent, such as benzyl alcohol, with
  (B) an aromatic hydrocarbon solvent that is compatible with the alcohol solvent, such as toluene and
  (C) 0 to 10 percent, preferably about 3 to about 8 percent by weight of the organic solvent mixture of a hydrophobic binder, such as poly(vinylbutryal) and then very thoroughly mixing the resulting product with
(III) comprising
  (A) a hydrophobic binder, such as poly(vinylbutryal) and
  (B) an oxidation-reduction image-forming combination comprising (i) an organic silver salt oxidizing agent, such as a silver salt of a long-chain fatty acid, preferrably silver behenate, with (ii) an organic reducing agent for the organic silver salt oxidizing agent, preferrably in an organic solvent, and (C) a stabilizer precursor according to the invention.

A photothermographic element according to the invention is prepared by coating the resulting photothermographic composition on a suitable support. Other solvent combinations are useful in preparing such photothermographic materials, such as described in U.S. Pat. No. 4,264,725, the description of which is incorporated herein by reference.

It is necessary that the photosensitive silver halide, as described, and other components of the imaging combination be "in reactive association" with each other in order to produce the desired image. The term "in reactive association" herein means that the photosensitive silver halide and the image-forming combination are in a location with respect to each other which enables the desired processing and produces a useful image.

The following examples are included for a further understanding of the invention.

EXAMPLE 1

This illustrates the invention.

The following components were mixed to form an emulsion (A):

| | grams |
|---|---|
| silver behenate dispersion (contains 19.4% by weight silver behenate in 5% by weight methyl iso butyl ketone (MIBK) solution of poly(vinylbutyral) (BUTVAR B-76 which is a trademark of and available from the Monsanto Co., U.S.A.)) (organic silver salt oxidizing agent) | 34.31 |
| sodium iodide (4% by weight NaI in acetone) (speed increasing addendum) | 1.67 |
| succinimide (10% by weight in acetone) (toner) | 7.97 |
| silver bromide (AgBr emulsion containing 32,28 gm of Ag per liter in 5% by weight MIBK solution of poly(vinylbutyral) (BUTVAR B-76) | 17.3 |
| benzenesulfonamidophenol (10% by weight in MIBK reducing agent) | 18.98 |
| poly(vinylbutyral) (BUTVAR B-76) (binder) | 4.6 |
| surfactant (10% by weight AF-70 in MIBK) (AF-70 is a silicone and is a trade name of the General Electric Co., U.S.A.) | 0.29 |
| methyl isobutyl ketone (solvent) | 4.1 |
| acetone (solvent) | 10.8 |

Twenty grams of emulsion (A) were mixed with 0.02 grams of the stabilizer precursor:

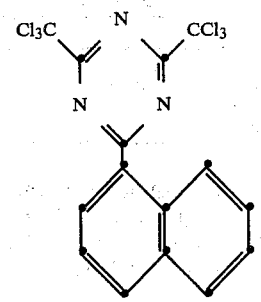

(2,4-bis(trichloromethyl)-6-(1-naphtho)-s-triazine)

The resulting photothermographic silver halide composition was coated at a wet coating thickness of 152.4 microns (6 mils) on a poly(ethyleneterephthalate) film support. The coating was permitted to dry and was then overcoated by means of a 127.0 micron (5 mils) wet coating thickness of a coating containing 4% by weight poly(acrylamide-co-N-vinyl-2-pyrrolidone-co-acetoacetoxy ethyl methacrylate) (50:40:10) in water (solvent). The overcoat was permitted to dry.

The resulting photothermographic element was imagewise exposed to light in a commercial sensitometer for $10^{-3}$ seconds to provide a developable latent image in the photothermographic element. The exposed photothermographic element was heated for 5 seconds at 115° C. to produce a developed silver image. The developed image had a maximum density of 2.87 and a minimum density of 0.29 with a relative Log E speed of 1.50 measured at 1.0 density above $D_{min}$. The developed image was stable.

The exposed and processed photothermographic element was subjected to 24 hours of white light from two 400 watt white fluorescent lights at a distance of 70 cm (about 24 inches) (about 150 fcs). After the twenty-four hours, the developed image in the photothermographic element had a minimum density of 0.22. The maximum density and relative speed of the image were not significantly changed.

EXAMPLE 2

An emulsion (A) was prepared as described in Example 1. To 150 gms of emulsion (A) was added 0.15 gms of 2,4-bis(trichloromethyl)-6-(1-naphtho)-s-triazine. The resulting photothermographic composition was coated at 73 ml/m$^2$ on a poly(ethyleneterephthalate) film support. The resulting coating was permitted to dry and was then overcoated with the following composition:

| | mg/m$^2$ |
|---|---|
| gelatin (binder) | 1610 |
| silica (1.3 micron particle size MIN-U-SIL which is available from and a trademark of Pennsylvania Glass & Sand Corp., U.S.A.) (matting agent) | 322 |
| surfactant (Surfactant 10G which is paraisononylphenoxypolyglycidol and is a trademark of and available from the | 122 |

-continued

| | mg/m² |
|---|---|
| Olin Corp., U.S.A.) bis(vinylsulfonylmethylether) (BVSME) (hardener) | 161 |

The photothermographic element contained 64.5 mg/m² of stabilizer precursor. The resulting photothermographic element was treated as follows:

I. (3 days incubation at 50% relative humidity and 38° C. (100° F.)).

The photothermographic element was cut into strips 35 mm wide and 30 cm long. Twelve of these strips were inserted into a black paper envelope which was placed in a yellow paper envelope. The yellow envelope containing the black envelope was then kept for three days in an incubator at 38° C. (100° F.) and 50% relative humidity. A set of control strips were kept at room temperature (about 20° C.) and ambient room humidity (about 50% relative humidity). After this three day incubation, the strips were equilabrated to ambient conditions, that is about 20° C. and 50% relative humidity. The strips were then imagewise exposed to light in a commercial sensitometer for $10^{-3}$ seconds to produce a developable latent image in the strips. The strips were then thermally processed by uniformly heating them for five seconds at 115° C.

The following strips from the group of strips were then checked for maximum and minimum density of the developed image and relative Log E speed measured at 1.0 density above $D_{min}$:

A. Control kept under ambient room conditions,

B. Incubated top strip,

C. Incubated middle strip

The results are given in following Table 2.

II. (Latent image keeping).

Three unexposed strips were imagewise exposed through a conventional step-wedge in a commerical sensitometer for $10^{-3}$ seconds to produce a developable latent image in the strips. The first of the exposed strips was immediately thermally processed after imagewise exposure. The thermal processing consisted of heating the exposed strip for five seconds at 115° C. The second exposed strip was thermally processed in the same manner five hours after the imagewise exposure. The third exposed strip was thermally processed in the same manner 24 hours after the imagewise exposure. The processed strips were checked for maximum and minimum density o the developed image and relative Log E speed measured at 1.0 density above $D_{min}$. The results are given in following Table 3.

III. (Reduction of Post-Processing Printout).

An unexposed strip was imagewise exposed to light in a commercial sensitometer for $10^{-3}$ seconds to produce a developable latent image in the strip. The exposed strip was then thermally processed by heating the strip for five seconds at 115° C. The exposed and thermally processed strip was then exposed to fluorescent white room light (light from fluorescent white tubes) for 24 hours. The difference between the minimum density (a) before fluorescent white light exposure and (b) after such exposure was measured. The result is given in following Table 4.

Tests (I), (II) and (III) indicated that the stabilizer precursor according to the example provides satisfactory reduction of post-processing print-out without significantly changing the latent image keeping properties, photographic speed or maximum density of the developed image.

EXAMPLES 3–5

The procedure described in Example 1 was repeated in each of Examples 3–5 with the exceptions that the following concentrations of the stabilizer precursor were added to 150 grams of emulsion (A):

| | grams: |
|---|---|
| Example 3 | 0.025 |
| Example 4 | 0.075 |
| Example 5 | 0.15 |

The resulting photothermographic compositions were coated on a poly(ethyleneterephthalate) film support at 73 ml/m². The resulting photothermographic element was permitted to dry and then overcoated with an overcoat as described in Example 1. The concentration of stabilizer precursor in the photothermographic elements was as follows:

| | mg/dm² |
|---|---|
| Example 3 | 10.8 |
| Example 4 | 32.3 |
| Example 5 | 64.5 |

The photothermographic elements were imagewise exposed to light and thermally processed to provide a developed image in each element. The images in the thermally processed photothermographic elements each had a minimum density of 0.19 immediately after thermal processing. The photothermographic elements were then exposed for 48 hours to white light from two 40 watt white fluorescent tubes at a distance of 45.7 cm. The minimum density of each of the images was as follows:

| | |
|---|---|
| Example 3 | 0.32 |
| Example 4 | 0.28 |
| Example 5 | 0.25 |

EXAMPLE 6

The procedure described in Example 1 was repeated with the exception that the stabilizer precursor was replaced by 0.075 grams of the compound 6A:

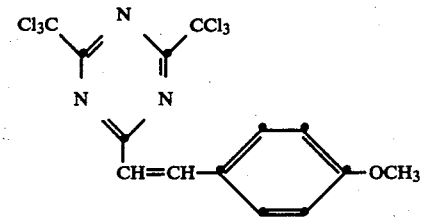

in each 150 grams of emulsion (A). The photothermographic composition was coated on a poly(ethyleneterephthalate) film support at 73 ml/m². The resulting photothermographic element contained 32.3 mg/m² of the compound 6A. The photothermographic element was permitted to dry and then overcoated with an overcoat as described in Example 1. The photothermographic element was imagewise exposed to light and thermally processed as described in Example 1 to provide a developed image. The thermally processed element had a minimum density of 0.20. The processed photothermographic element was then exposed for 48 hours to white light from two 40 watt white fluorescent tubes at a distance of 45.7 cm. The minimum density of the image after this white light exposure was 0.28.

EXAMPLE 7

The procedure described in Example 1 was repeated with the exception that the stabilizer precursor was replaced by 0.075 grams of the compound 7A:

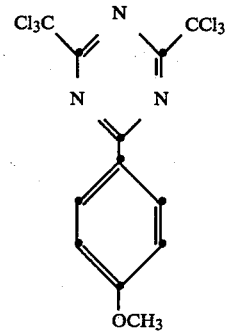

in each 150 grams of emulsion (A). The photothermographic composition was coated on a poly(ethyleneterephthalate) film support at 73 ml/m$^2$. The resulting photothermographic element contained 32.3 mg/m$^2$ of the compound 7A. The photothermographic element was permitted to dry and then overcoated with an overcoat as described in Example 1. The photothermographic element was imagewise exposed to light and thermally processed as described in Example 1 to provide a developed image. The processed photothermographic element had a minimum density of 0.18. The processed photothermographic element was then exposed for 48 hours to white light from two 40 watt white fluorescent tubes at a distance of 45.7 cm. The minimum density of the image after this white light exposure was 0.28.

EXAMPLE 8

The procedure described in Example 1 was repeated with the exception that the stabilizer precursor was replaced by 0.075 grams of compound 8A:

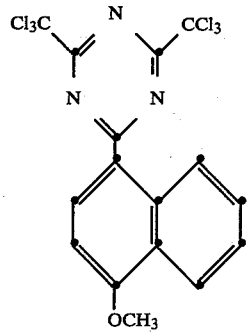

in each 150 grams of emulsion (A). The photothermographic composition was coated on a poly(ethyleneterephthalate) film support at 73 ml/m$^2$. The resulting photothermographic element contained 32.3 mg/m$^2$ of the compound 8A. The photothermographic element was permitted to dry and then overcoated with an overcoat as described in Example 1. The photothermographic element was imagewise exposed to light and thermally processed as described in Example 1 to provide a developed image. The processed photothermographic element had a minimum density of 0.19. The processed photothermographic element was then exposed for 48 hours to white light from two 40 watt white fluorescent tubes at a distance of 45.7 cm. The minimum density of the image after this white light exposure was 0.29.

EXAMPLE 9

This illustrates use of a combination of stabilizer precursors in a photothermographic material.

A photothermographic composition was prepared and coated on a poly(ethyleneterephthalate) film support at the following coverages:

| | mg/m$^2$ |
|---|---|
| Photothermographic layer: | |
| Silver behenate | 3830 |
| (silver salt oxidizing agent) | |
| AgBr | 785 |
| NaI | 37.7 |
| (speed increasing addendum) | |
| Succinimide | 452 |
| (toner) | |
| 4-Benzenesulfonimidophenol | 1076 |
| (reducing agent) | |
| Poly(vinylbutyral) | 3600 |
| (BUTVAR B-76, binder) | |
| Silicone surfactant | 16.1 |
| 2,4-Dihydroxybenzophenone | — |
| Sensitizing dye | 5.4 |
| 2,4-bis(trichloromethyl-6-(1-naphtho)-s-triazine | 64.5 |
| (stabilizer precursor) | |
| (according to the present invention) | |
| 2-bromo-2-p-tolylsulfonyl acetamide | 64.5 |
| (stabilizer precursor) | |
| Overcoat: | |
| Photographic gelatin | 1720 |
| Colloidal Silica | 344 |
| Surfactant combination | 201.1 |

Five strips (35 mm wide and 30.5 cm long) were thermally processed without light exposure by heating the strips for five seconds at 115° C. in a thermal processor. The strips had a $D_{min}$ of 0.16 (observed through a Status A blue filter in a commercial densitometer). Then the strips were exposed consecutively to (a) the light in a Commercial microfilm reader apparatus (a Kodak EKTALITE 140 Reader available from Eastman Kodak Co., U.S.A. Kodak EKTALITE is a trademark of Eastman Kodak Co., U.S.A.) for 30 seconds, (b) room light (100 fc.) for 1 hour, and then (c) passed ten times through a commercial diazo printer containing an ultraviolet light source (Kodak Recordak NB404 Diazo Printer, available from Eastman Kodak Co, U.S.A.)

After this treatment, the strips had a $D_{min}$ of 0.18. No significant increase in $D_{min}$ was observed.

The following examples are comparative examples:

EXAMPLE A

The procedure described in Example 1 was repeated with the exception that the stabilizer precursor was replaced by the compound:

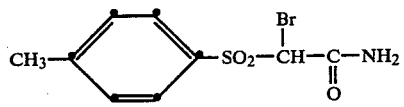

The developed image had a maximum density of 2.87 and a minimum density of 0.24 with a relative Log E speed of 1.58 measured at 1.0 density above $D_{min}$.

The exposed and processed photothermographic element was subjected to 24 hours of white light from two 400 watt white fluorescent lights at a distance of 61 cm (24 inches). After the twenty-four hours the developed image had minimum density of 0.40.

EXAMPLE B

The procedure described in Example 1 was repeated with the exception that the stabilizer precursor was replaced by the compound:

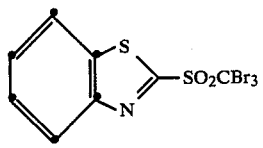

The developed image had a maximum density of 2.71 and a minimum density of 0.21 with a relative Log E speed of 1.41 measured at 1.0 density above $D_{min}$.

The exposed and processed photothermographic element was subjected to 24 hours of white light from two 400 watt white fluorescent lights at a distance of 61 cm (24 inches). After twenty-four hours, the developed image had a minimum density of 0.30.

EXAMPLE C

The procedure described in Example 1 was repeated with the exception that the stabilizer precursor was replaced by the compound:

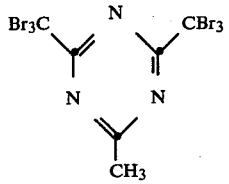

The developed image had a maximum density of 2.57 and a minimum density of 0.22 with a relative Log E speed of 1.16.

The exposed and processed photothermographic element was subjected to 24 hours of white fluorescent lights at a distance of 61 cm (24 inches). After twenty-four hours, the developed image had a minimum density of 0.24. The results of Examples A, B and D compared to the results of Example 1 are summarized in following Table 1:

TABLE 1

| Example No. | $D_{max}$ | $D_{min}$ | Relative Log E Speed | Printout $D_{min}$ (after 24 hrs.) exposure to fluoroscent lights) |
|---|---|---|---|---|
| A (comparative example) | 2.87 | 0.24 | 1.58 | 0.40 |
| B (comparative example) | 2.71 | 0.21 | 1.41 | 0.30 |
| C (comparative example) | 2.57 | 0.22 | 1.16 | 0.24 |
| 1 (invention) | 2.87 | 0.29 | 1.50 | 0.22 |

This illustrates that a photothermographic element according to Example 1 of the invention provides lower printout minimum density than the photothermographic elements of comparative Examples A, B and C.

EXAMPLE D

The procedure described in Example 2 was repeated with the exception that the stabilizer precursor was replaced by the compound:

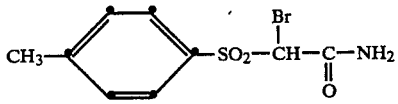

at a concentration of 64.5 mg/m$^2$. The results are given in following Tables 2, 3 and 4.

EXAMPLES E–G

The procedures described in Example 2 were repeated three times with the exception that the stabilizer precursor was replaced by the compound:

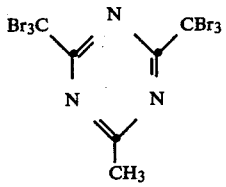

at respective concentrations of 16.1 mg/m$^2$ (Example E), 32.3 mg/m$^2$ (Example F) and 64.5 mg/m$^2$ (Example G). The results are summarized in following Tables 2, 3 and 4:

TABLE 2

| Example No. | | (Test I) Control | T/S** | M/S*** |
|---|---|---|---|---|
| — (control) (no stabilizer precursor) | Speed* | 1.57 | 1.34 | 1.65 |
| | D-max | 2.61 | 2.49 | 2.41 |
| | D-min | 0.18 | 1.07 | 0.18 |
| D (comparative example) | Speed | 1.49 | 1.54 | 1.48 |
| | D-max | 2.63 | 2.42 | 2.48 |
| | D-min | 0.18 | 0.20 | 0.19 |
| E (comparative example) | Speed | 1.30 | 1.14 | 1.18 |
| | D-max | 2.52 | 2.23 | 2.29 |
| | D-min | 0.19 | 0.21 | 0.20 |
| F (comparative example) | Speed | 1.20 | 1.02 | 1.03 |
| | D-max | 2.52 | 2.22 | 2.13 |
| | D-min | 0.20 | 0.22 | 0.20 |
| G (comparative example) | Speed | 1.05 | 0.78 | 0.80 |
| | D-max | 2.49 | 2.17 | 2.19 |
| | D-min | 0.20 | 0.22 | 0.21 |
| 2 (invention) | Speed | 1.39 | 1.43 | 1.37 |
| | D-max | 2.63 | 2.43 | 2.34 |

TABLE 2-continued

| Example No. | (Test I) Control | T/S** | M/S*** |
|---|---|---|---|
| D-min | 0.18 | 0.20 | 0.18 |

*Speed — Relative Log E for strips exposed in a commercial sensitometer for $10^{-3}$ seconds and processed for 5 seconds at 115° C.
D-max — Maximum density (blue status "A" filter) obtained at the specified exposure and development conditions.
D-min — Background density read using blue status "A" filter.
**T/S means top sheet.
***M/S means middle of the stack.

TABLE 3

| Example No. | | Initial Speed | Initial D-max | 5 hr Delay Speed | 5 hr Delay D-max | 24 hr Delay Speed | 24 hr Delay D-max | Change in Speed 24 hrs |
|---|---|---|---|---|---|---|---|---|
| Control | (no stabilizer precursor) | — | — | — | — | — | — | — |
| D | (comparative example) | 1.54 | 2.57 | 1.33 | 2.53 | 1.36 | 2.49 | 0.18 |
| E | (comparative example) | 1.29 | 2.47 | 0.95 | 2.06 | 0.63 | 1.51 | 0.66 |
| F | (comparative example) | 1.20 | 2.37 | 0.65 | 1.71 | — | — | |
| G | (comparative example) | 1.04 | 2.46 | 0.30 | 1.36 | — | — | |
| 2 | (invention) | 1.41 | 2.57 | 1.33 | 2.53 | 1.25 | 2.48 | 0.16 |

Table 3 illustrates that a stabilizer precursor according to the invention (Example 2) provides lower changes in photographic speed without significant changes in maximum image density compared to the stabilizer precursors of Examples D, E, F and G.

TABLE 4

| Example No. | D-min$_B$ | Printout D-min$_B$ |
|---|---|---|
| — (control) (no stabilizer precursor) | 0.18 | 0.43 |
| D (comparative example) | 0.18 | 0.34 |
| E (comparative example) | 0.19 | 0.34 |
| F (comparative example) | 0.20 | 0.29 |
| G (comparative example) | 0.20 | 0.27 |
| 2 (invention) | 0.18 | 0.21 |

Dmin$_B$ herein means density of unexposed areas read with Status A blue filter. Table 4 illustrates that a stabilizer precursor according to the invention (Example 2) provides lower printout $D_{min}$ than the stabilizer precursors of Examples D, E, F and G.

EXAMPLES H–L

The procedure described in Example 1 was repeated with the exception that the following stabilizer precursors at the concentrations listed in Table 5 replaced the stabilizer precursor of Example 2.

TABLE 5

| Comparative Example No. | Comparative Stabilizer Precursor | Concentration grams added | Concentration mg/m$^2$ |
|---|---|---|---|
| H | 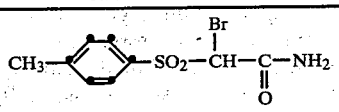 | 0.15 | 64.5 |

TABLE 5-continued

| Comparative Example No. | Comparative Stabilizer Precursor | Concentration grams added | Concentration mg/m$^2$ |
|---|---|---|---|
| I | 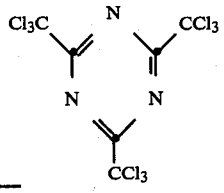 | 0.025 | 10.8 |
| J | 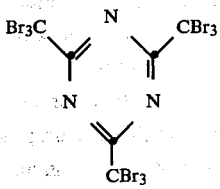 | 0.025 | 10.8 |
| K | 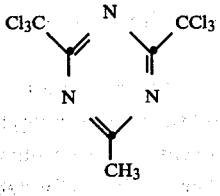 | 0.025 | 10.8 |
| L | 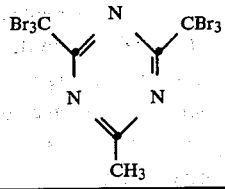 | 0.025 | 10.8 |

The exposed and thermally processed photothermographic elements were subjected to 48 hours of white light from two 400 watt white fluorescent lights at a distance of 45.7 cm. The results of Examples H–L compared to Example 3–8 are summarized in following Table 6:

TABLE 6

| Example No. | | Initial D-min$_B$ | Printout D-min$_B$ |
|---|---|---|---|
| Control | (no stabilizer precursor) | 0.19 | 0.36 |
| H | | 0.19 | 0.32 |
| I | | 0.20 | 0.32 |

TABLE 6-continued

| Example No. | Initial D-min$_B$ | Printout D-min$_B$ |
|---|---|---|
| J | 0.20 | 0.32 |
| K | 0.20 | 0.33 |
| L | 0.21 | 0.33 |
| 3 | 0.19 | 0.32 |
| 4 | 0.19 | 0.28 |
| 5 | 0.19 | 0.25 |
| 6 | 0.20 | 0.28 |
| 7 | 0.18 | 0.28 |
| 8 | 0.19 | 0.29 |

The Dmin data for Example 3 indicates that a higher concentration of the stabilizer precursor of this Example is preferred, such as the concentration present in Examples 4 and 5. No attempt was made to optimize the concentrations of components in these examples.

The invention has been described in detail with particular reference to preferred embodiments thereof, but it will be understood that variations and modifications can be effected within the spirit and scope of the invention.

What is claimed is:

1. In a photothermographic element comprising a support having thereon, in reactive association, (a) photographic silver halide, (b) an image forming combination comprising (i) an organic silver salt oxidizing agent, with (ii) a reducing agent for the organic silver salt oxidizing agent, and (c) a silver halide stabilizer precursor, the improvement wherein said stabilizer precursor is a photolytically active 6-substituted-2,4-bis(trichloromethyl)-s-triazine which has a maximum absorption wavelength greater than 320 nm, is thermally stable at temperatures up to 150° C. and is present in a stabilizing concentration sufficient to promote latent image stabilization and post-processing stabilization.

2. A photothermographic element as in claim 1 wherein said stabilizer precursor is a compound selected from the group consisting of

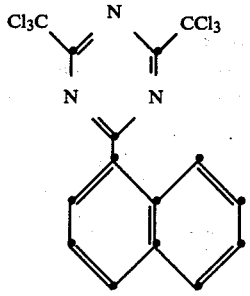

-continued

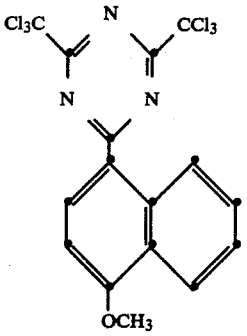

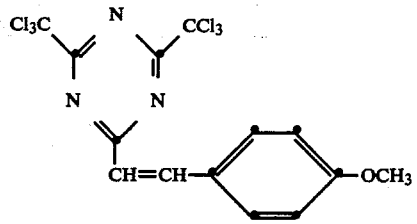

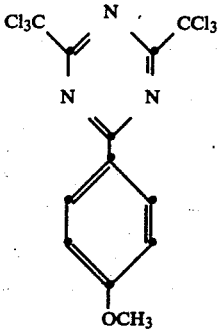

and combinations thereof.

3. A photothermographic element as in claim 1 comprising a toner.

4. A photothermographic element as in claim 1 comprising a toner which is a compound selected from the group consisting of succinimide, phthalazinone, phthalimide, phthalazine and N-hydroxynaphthalimide.

5. A photothermographic element as in claim 1 comprising a thermal stabilizer consisting essentially of 2-bromo-2-arylsulfonylacetamide.

6. A photothermographic element as in claim 1 comprising a thermal stabilizer consisting essentially of 2-bromo-2-p-tolylsulfonylacetamide.

7. A photothermographic element as in claim 1 comprising a binder.

8. A photothermographic element as in claim 1 comprising a poly(vinyl butyral) binder.

9. In a photothermographic element comprising a support having thereon, in a poly(vinyl butyral) binder, in reactive association, (a) photographic silver halide, (b) an image forming combination comprising (i) an organic silver salt oxidizing agent consisting essentially of silver behenate, with (ii) a reducing agent for the organic silver salt oxidizing agent consisting essentially of a sulfonamidophenol silver halide developing agent, (c) a thermal stabilizer consisting essentially of 2-bromo-2-arylsulfonylacetamide, (d) a toner, and (e) a silver halide stabilizer precursor, the improvement wherein said stabilizer precursor is

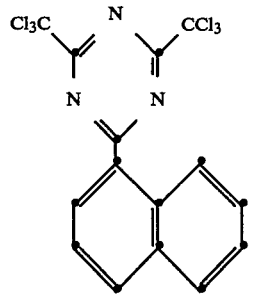

(2,4-bis(trichloromethyl)-6-(1-naphtho)-s-triazine)

and is present in a stabilizing concentration sufficient to promote latent image stabilization and post-processing stabilization.

10. A process of developing an image in an exposed photothermographic element as defined in claim 1 comprising heating said element to a temperature within the range of about 90° C. to about 150° C. until said image is developed.

11. A process of developing an image in a radiation exposed photothermographic element as defined in claim 9 comprising heating said element to a temperature within the range of about 90° C. to about 150° C. until said image is developed.

12. In a photothermographic element comprising a support having thereon, in reactive association, (a) photographic silver halide, (b) an image forming combination comprising (i) an organic silver salt oxidizing agent, with (ii) a reducing agent for the organic silver salt oxidizing agent, and (c) a silver halide stabilizer precursor, the improvement wherein said stabilizer precursor is a photolytically active 6-substituted-2,4-bis(trichloromethyl)-s-triazine which has a maximum absorption wavelength greater than 320 nm, is thermally stable at temperatures up to 150° C., is represented by the formula:

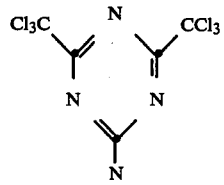

wherein

R is aryl containing 6 to 15 carbon atoms or —CH=CH—$R^1$, $R^1$ is aryl containing 6 to 15 carbon atoms and is present in a stabilizing concentration sufficient to promote latent image stabilization and post-processing stabilization.

* * * * *

UNITED STATES PATENT AND TRADEMARK OFFICE

CERTIFICATE OF CORRECTION

PATENT NO. : 4,459,350
DATED : July 10, 1984
INVENTOR(S) : W.M. Przezdziecki

It is certified that error appears in the above-identified patent and that said Letters Patent are hereby corrected as shown below:

Column 15, line 66, "D" should read -- C --.

Column 22, the structure should read

-- 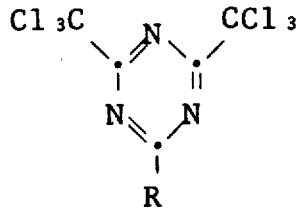 --.

Signed and Sealed this

*Twelfth* Day of *November 1985*

[SEAL]

*Attest:*

DONALD J. QUIGG

*Attesting Officer*

*Commissioner of Patents and Trademarks*